US010539151B2

(12) United States Patent
Yamada

(10) Patent No.: US 10,539,151 B2
(45) Date of Patent: Jan. 21, 2020

(54) CENTRIFUGAL COMPRESSOR CASING AND CENTRIFUGAL COMPRESSOR

(71) Applicant: MITSUBISHI HEAVY INDUSTRIES COMPRESSOR CORPORATION, Tokyo (JP)

(72) Inventor: Hideki Yamada, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 262 days.

(21) Appl. No.: 15/546,221

(22) PCT Filed: Jan. 27, 2015

(86) PCT No.: PCT/JP2015/052131

§ 371 (c)(1),
(2) Date: Jul. 25, 2017

(87) PCT Pub. No.: WO2016/120984

PCT Pub. Date: Aug. 4, 2016

(65) Prior Publication Data

US 2018/0017073 A1 Jan. 18, 2018

(51) Int. Cl.

| | |
|---|---|
| ***F04D 29/42*** | (2006.01) |
| ***F04D 29/44*** | (2006.01) |
| ***F04D 17/12*** | (2006.01) |

(52) U.S. Cl.

CPC ..... *F04D 29/441* (2013.01); *F04D 17/12* (2013.01); *F04D 29/422* (2013.01); *F04D 29/428* (2013.01); *F04D 29/4226* (2013.01)

(58) Field of Classification Search

CPC .. F04D 29/441; F04D 17/122; F04D 29/4206; F04D 29/426; F04D 29/428;

(Continued)

(56) References Cited

U.S. PATENT DOCUMENTS 1,456,051 A * 5/1923 Carter ..... F04D 1/10 235/61 B
1,778,015 A * 10/1930 Becker ..... F04D 29/4253 232/41 B (Continued)

FOREIGN PATENT DOCUMENTS

| | | |
|---|---|---|
| JP | S58-027597 | 2/1983 |
| JP | S63-166699 U | 10/1988 |
| JP | H04-010112 U | 1/1992 |

OTHER PUBLICATIONS

International Search Report issued in corresponding International Application No. PCT/JP2015/052131 dated Apr. 21, 2015, with translation (4 pages).

(Continued)

*Primary Examiner* — Dwayne J White
*Assistant Examiner* — Wesley Le Fisher
(74) *Attorney, Agent, or Firm* — Osha Liang LLP

(57) ABSTRACT

A centrifugal compressor casing, comprising a bundle which rotatably supports a rotating shaft, and an impeller fixed to the rotating shaft and that rotates with the rotating shaft about an axis of the rotating shaft, and in which an annular suction flow channel centered on the axis introduces fluid into the flow channel of the impeller, and an annular discharge flow channel centered on the axis that discharges the fluid from the flow channel of the impeller, are formed; a casing main body which covers the bundle from the outer circumferential side; and a volute piece which is provided on an inner surface of the casing main body in the discharge flow channel.

7 Claims, 5 Drawing Sheets

(58) Field of Classification Search
CPC .... F04D 29/4286; F04D 17/12; F04D 17/125; F04D 29/422; F04D 29/624; F04D 29/4233; F01D 1/06; F05D 2250/52
USPC ..... 415/206, 207
See application file for complete search history.

(56) References Cited

U.S. PATENT DOCUMENTS

| | | | | | |
|---|---|---|---|---|---|
| 2,248,312 | A * | 7/1941 | Stepanoff | F04D 1/063 | 415/108 |
| 3,091,182 | A * | 5/1963 | Anderson | F04D 29/445 | 124/6 |
| 3,732,028 | A * | 5/1973 | Heynemanns | F04D 29/4286 | 415/197 |
| 4,919,592 | A | 4/1990 | Sears et al. | | |
| 6,152,691 | A * | 11/2000 | Thut | F04D 7/065 | 415/197 |
| 2015/0337844 | A1* | 11/2015 | Eschner | F04D 13/025 | 417/423.14 |

OTHER PUBLICATIONS

Written Opinion of the International Searching Authority issued in PCT/JP2015/052131 dated Apr. 21, 2015, with translation (10 pages).

* cited by examiner

CENTRIFUGAL COMPRESSOR CASING AND CENTRIFUGAL COMPRESSOR

TECHNICAL FIELD

The present invention relates to a casing in a centrifugal compressor and a centrifugal compressor including the casing.

BACKGROUND ART

For example, in various plants, a centrifugal compressor is used to compress a process gas. In the centrifugal compressor, the process gas suctioned into a casing from a suction port is compressed in a flow channel of an impeller by rotation of the impeller together with a rotating shaft, and is discharged outside of the casing from a discharge port.

A discharge volute communicating with the discharge port is formed in the centrifugal compressor casing. The discharge volute keeps the flow velocity of the process gas constant and reduces pressure loss.

Generally, the discharge volute is formed by welding a volute piece, which is a separate member from the casing, to an annular groove formed on an inner surface of the casing (see Patent Literature 1).

CITATION LIST

Patent Literature

Patent Literature 1

Japanese Unexamined Utility Model Application First Publication No. S63-166699

However, in recent years, since a super-high-pressure centrifugal compressor has been required, for example, it has also become necessary to use a high-strength material as a material of a casing. However, when a volute piece is welded to such a high-strength material casing, a high preheating temperature is required and an advanced welding technique is required to prevent cracking of the welded portion. Also, safety management is very difficult when performing a welding operation at high temperatures.

SUMMARY OF INVENTION

One or more embodiments of the present invention provide a centrifugal compressor casing and a centrifugal compressor including the casing in which a discharge volute can be formed easily irrespective of a material.

A centrifugal compressor casing according to a first aspect of the present invention may include a bundle which rotatably supports a rotating shaft, and an impeller fixed to the rotating shaft and rotating with the rotating shaft about an axis of the rotating shaft, and in which an annular suction flow channel centered on the axis configured to introduce fluid into the flow channel of the impeller, and an annular discharge flow channel centered on the axis configured to discharge the fluid from the flow channel of the impeller are formed; a casing main body which covers the bundle from the outer circumferential side; a volute piece which is provided on an inner surface of the casing main body in the discharge flow channel, and has a thickness dimension in the radial direction of the rotating shaft which gradually decreases toward the outlet of the discharge flow channel in a downstream side in a flowing direction of the fluid, in the circumferential direction of the rotating shaft; and a fastening member which fixes the volute piece to the casing main body.

According to one or more embodiments, by fastening and fixing the volute piece to the discharge flow channel in the casing main body, using the fastening member, the discharge volute can be formed in the casing. Therefore, unlike a case where the volute piece is welded and fixed to the casing main body, it is possible to avoid the occurrence of cracking in the welded portion of the casing main body or the volute piece when fixing the volute piece. Also, since the volute piece is fixed only by the fastening member without using welding, an advanced technique is not required when fixing the volute piece.

Further, in the centrifugal compressor casing according to a second aspect of the present invention, the fastening member of the first aspect may penetrate the casing main body from outside in the radial direction and is fixed to the volute piece to fix the volute piece to the casing main body, and the centrifugal compressor casing may further include a closing member which is provided on the casing main body from the outside in the radial direction, and closes a through-hole through which the fastening member penetrates the casing main body.

According to one or more embodiments, by providing the fastening member from the outside of the casing main body in this manner, the volute piece is fixed to the casing main body. Thus, the fixing work of the volute piece is easy and the manufacturing workload can be reduced. Further, by providing the closing member, it is possible to prevent the fluid in the discharge flow channel from leaking outside of the casing main body through the through-hole.

Further, in the centrifugal compressor casing according to a third aspect of the present invention, the fastening member of the first aspect may penetrate the volute piece from the inside in the radial direction and may be fixed to the casing main body to fix the volute piece to the casing main body.

According to one or more embodiments, by providing the fastening member from the inside of the casing main body in this manner, it is possible to prevent the fastening member from penetrating the casing main body. Thus, the discharge flow channel does not open to the outside of the casing main body, and it is not necessary to separately provide a member which closes such an opening.

Further, in the centrifugal compressor casing according to a fourth aspect of the present invention, the volute piece of any one of the first to third aspects may have a first piece portion disposed on a downstream side in the flowing direction of the fluid; and a second piece portion which is formed separately from the first piece portion and is disposed on the upstream side of the first piece portion in the flowing direction of the fluid.

According to one or more embodiments, by dividing the volute piece into the first piece portion and the second piece portion, it is easy to fix the volute piece to the casing main body.

Furthermore, according to one or more embodiments, when pressure is exerted on the casing main body during operation of the centrifugal compressor and the casing main body is deformed, as compared with a case where the volute piece is integrally formed without being divided, if a gap is formed between the divided portions of the first piece portion and the second piece portion, it is possible to absorb the deformation of the casing main body using the divided portions. Therefore, it is possible to suppress cracking of the volute piece at the time of deformation of the casing main body.

Further, in the centrifugal compressor casing according to a fifth aspect of the present invention, one of the first piece portion and the second piece portion of the fourth aspect may have a protruding portion which protrudes toward the other in the circumferential direction, the other of the first piece portion and the second piece portion may have an engaging portion which is engaged with the protruding portion and is supported from the inside in the radial direction by the protruding portion, and the fastening member may be provided in only the one of the first piece portion and the second piece portion.

In some cases, it may be difficult to fasten and fix one of the first piece portion and the second piece portion to the casing main body due to the absence of working space or the interference of the components of the casing main body. According to one or more embodiments, even in such a case, if only one of the first piece portion and the second piece portion is fastened and fixed to the casing main body by supporting the engaging portion with the protruding portion, it is also possible to fix the other of the first piece portion and the second piece to the casing main body. That is, when one of the first piece portion and the second piece portion is fixed to the casing main body with the fastening member, the protruding portion supports the engaging portion to press the engaging portion against the casing main body, and it is also possible to fix the other of the first piece portion and the second piece portion to the casing main body by the fastening member.

Further, in the centrifugal compressor casing according to a sixth aspect of the present invention, the first piece portion of the fifth aspect may be the one piece portion and may have the protruding portion, and the second piece portion may be the other and may have an engaging portion.

According to one or more embodiments, since only the first piece portion on the downstream side is supported by the fastening member, the fastening member can be provided at a position spaced apart from the outlet of the discharge flow channel. Therefore, it is possible to prevent interference of the fastening member with the discharge port or the like connected to the discharge flow channel, and it is possible to easily fix the volute piece to the casing main body.

In the centrifugal compressor casing according to a seventh aspect of the present invention, a material of the casing main body of any one of first to fifth aspects may be a high-strength material having a yield strength of 500 [N/mm$^2$] or more.

According to one or more embodiments, by using such a high-strength material for the casing main body, it is possible to compress the fluid at ultra-high pressure. Also when such a high-strength material is used, it is possible to fix the volute piece to the casing main body, without using welding. Therefore, it is possible to avoid the occurrence of cracking in the welded portion of the casing main body or the volute piece when fixing the volute piece. Since no welding is used, high technique is not required when fixing the volute piece. That is, it is possible to easily form the discharge volute in the casing, regardless of the material of the casing main body.

Further, a centrifugal compressor according to an eighth aspect of the present invention may include the casing according to any one of the first to seventh aspects; a rotating shaft supported by the casing to be rotatable with respect to the casing; and an impeller which is fixed to the rotating shaft and rotates inside the bundle with the rotating shaft.

According to one or more embodiments, since the casing is provided, a discharge volute can be formed in the casing, by fastening and fixing the volute piece to the discharge flow channel in the casing main body. Therefore, unlike the case where the volute piece is welded and fixed to the casing main body, it is possible to avoid the occurrence of cracking in the welded portion of the casing main body or the volute piece due to heat, when fixing the volute piece, and high technique is not required when forming the discharge volute.

According to one or more embodiments of the centrifugal compressor casing and the centrifugal compressor, the volute piece can be easily fixed to the casing main body to form the discharge volute, regardless of the material of the casing main body.

DETAILED DESCRIPTION OF EMBODIMENTS

First Embodiment

Hereinafter, a centrifugal compressor 1 according to one or more embodiments of the present invention will be described. However, the invention is not limited to only these embodiments.

Figure 1:
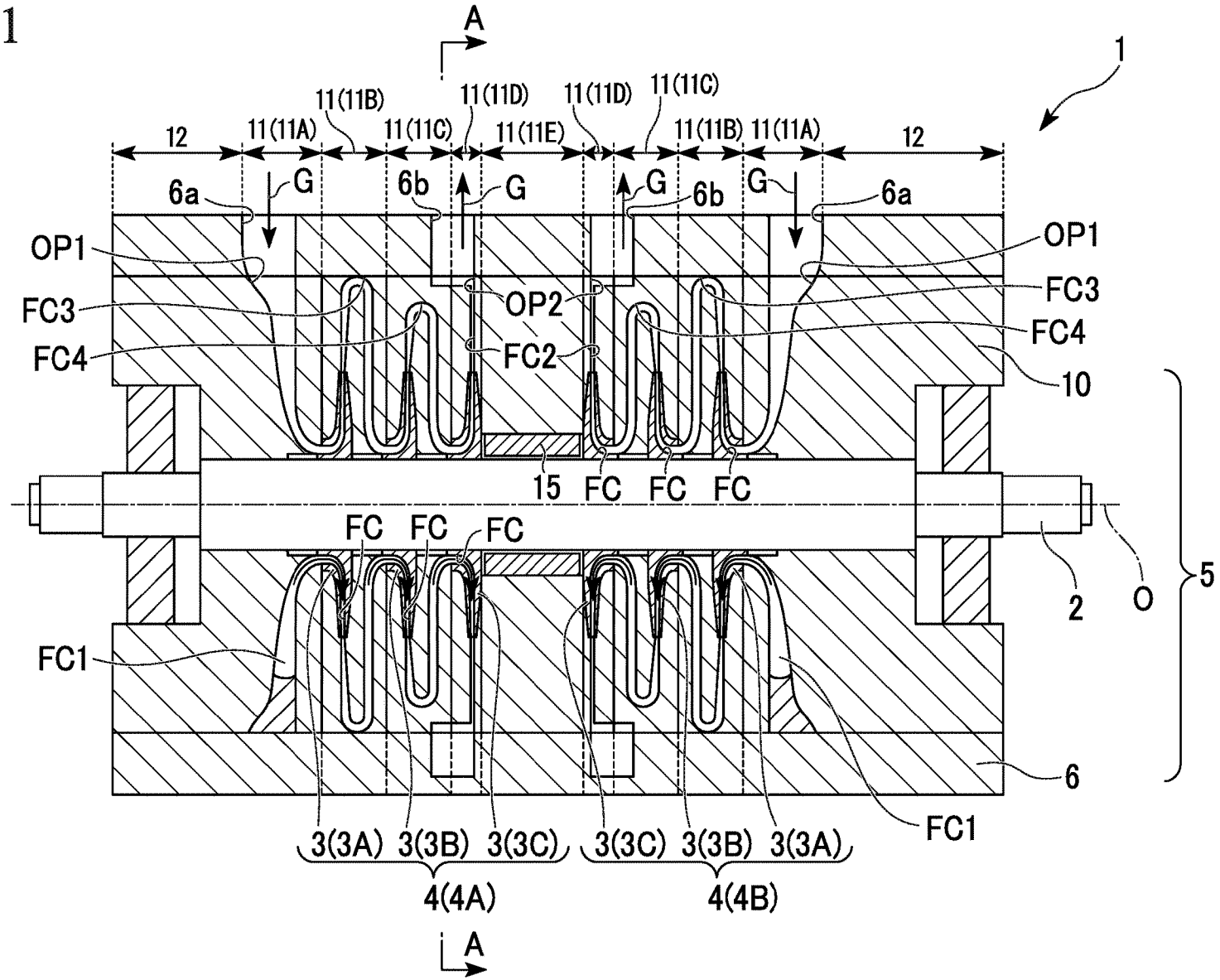
FIG. 1 is a longitudinal sectional view illustrating a schematic configuration of a centrifugal compressor according to a first embodiment of the present invention.

As illustrated in FIG. 1, in this embodiment, as an example of the centrifugal compressor 1, a multi-stage centrifugal compressor in which a pair of three-stage impeller groups 4 rotating about an axis O are disposed symmetrically on one side and the other side in the direction of the axis O will be described.

The centrifugal compressor 1 includes a rotating shaft 2 that rotates about an axis O, a plurality of impellers 3 fixed to the rotating shaft 2, and a casing 5 that rotatably supports the rotating shaft 2 and the impeller 3.

The rotating shaft 2 has a columnar shape centered on the axis O.

A plurality of impellers 3 (six in the present embodiment) are arranged to be spaced apart from each other in the direction of the axis O.

Each impeller 3 has a substantially disk shape and is rotatable about the axis O together with the rotating shaft 2 by being fitted to the rotating shaft 2. A flow channel FC through which a process gas G (fluid) can flow is formed inside each impeller 3.

Three impellers 3 disposed on one side in the direction of the axis O (on the left side as viewed in FIG. 1) are disposed such that the inlet of the flow channel FC faces one side in the direction of the axis O, and constitute a single impeller group 4 (hereinafter referred to as a first impeller group 4A).

The three-stage impellers 3 disposed on the other side in the direction of the axis O (on the right side as viewed in FIG. 1) are disposed such that the inlet of the flow channel FC faces the other side in the direction of the axis O, and constitute a single impeller group 4 (hereinafter referred to as a second impeller group 4B).

The casing 5 includes a bundle 10 having a plurality of disk-shaped diaphragms 11 centered on the axis O, a casing main body 6 that covers the bundle 10 from the outer circumference side, a volute piece 19 separately provided in the casing main body 6, a fastening member 30 that fixes the volute piece 19 to the casing main body 6, and a closing member 31 provided to cover the fastening member 30.

The bundle 10 is formed by coupling a plurality of diaphragms 11 and a head 12 with a bolt (not illustrated) or the like in the direction of the axis O. That is, the bundle 10 has a structure divided into a plurality of sections in a cross section orthogonal to the axis O.

In the bundle 10, a pair of heads 12 are members that are provided to sandwich the plurality of diaphragms 11 at both ends of the axis O from the direction of the axis O, and form a disk shape centered on the axis O.

Each diaphragm 11 has a structure that is divided into upper and lower parts on a horizontal plane including the axis O.

In the bundle 10, the diaphragms 11 at the end portions on one side and the other side in the direction of the axis O are suction diaphragms 11A. The suction diaphragms 11A have a suction flow channel FC1 formed therein, which has an annular shape centered on the axis O so that the process gas G can be introduced into the flow channel FC of the impeller 3. The suction flow channels FC1 have a suction flow channel opening OP1 formed therein, which opens toward the outside in the radial direction in a part of the suction diaphragm 11A in the circumferential direction (an upper part in the present embodiment).

In the bundle 10, the diaphragm 11 which covers an initial stage (first stage) impeller 3 (3A) in the first impeller group 4A and the second impeller group 4B is a first intermediate diaphragm 11B. The first intermediate diaphragm 11B has a return flow channel FC3 formed therein, through which the outlet of the flow channel FC of the initial stage impeller 3 (3A) and the inlet of the flow channel FC of the intermediate stage (second stage) impeller 3 (3B) communicate with each other.

Similarly, in the bundle 10, the diaphragm 11 which covers the impeller 3 (3B) of the intermediate stage (second stage) in the first impeller group 4A and the second impeller group 4B is a second intermediate diaphragm 11C. The second intermediate diaphragm 11C has a return flow channel FC4 formed therein, through which the outlet of the flow channel FC of the intermediate stage impeller 3 (3B) and the inlet of the flow channel FC of the final stage (third stage) impeller 3 (3C) communicate with each other.

Further, the second intermediate diaphragm 11C has a part of the discharge flow channel FC2 formed therein, which has an annular shape centered on the axis O, and allows the process gas G to be discharged from the flow channel FC of the impeller 3.

In the bundle 10, the diaphragm 11 which covers the impeller 3 (3C) of the final stage (third stage) in the first impeller group 4A and the second impeller group 4B is a discharge diaphragm 11D. The discharge diaphragm 11D has a remaining part of the discharge flow channel FC2 formed therein, which has an annular shape centered on the axis O, and allows the process gas G to be discharged from the flow channel FC of the impeller 3.

That is, the discharge flow channel FC2 is formed by the discharge diaphragm 11D and the second intermediate diaphragm 11C. In the discharge flow channel FC2, a discharge flow channel opening OP2 (outlet) which opens radially outward at a part in the circumferential direction (upper part in this embodiment) in the second intermediate diaphragm 11C and the discharge diaphragm 11D is formed.

In the bundle 10, the diaphragm 11 disposed at a position between the first impeller group 4A and the second impeller group 4B is a final interstage diaphragm 11E. The final interstage diaphragm 11E is provided with a sealing device 15 which seals the flow of the process gas G between the first impeller group 4A and the second impeller group 4B on the outer circumferential side of the rotating shaft 2.

The casing main body 6 is formed of a high-strength material, for example, one having a yield strength of 500 [N/mm$^2$] or more. As such a high-strength material, SFCM 880 and the like are adopted as an example.

The casing main body 6 has a cylindrical shape, covers the bundle 10 from the outer circumferential side, and fixes the bundle 10. In the casing main body 6, a pair of suction ports 6*a* which extend radially to open outward and communicate with the suction flow channel opening OP1 are formed. In addition, in the casing main body 6, a pair of discharge ports 6*b*, which extend in the radial direction to open outward and communicate with the discharge flow channel opening OP2, are formed.

The volute piece 19 is provided on the inner surface 6*c* of the casing main body 6 forming the discharge flow channel FC2 in the discharge flow channel FC2 formed between the second intermediate diaphragm 11C and the discharge diaphragm 11D in the bundle 10.

Figure 2:
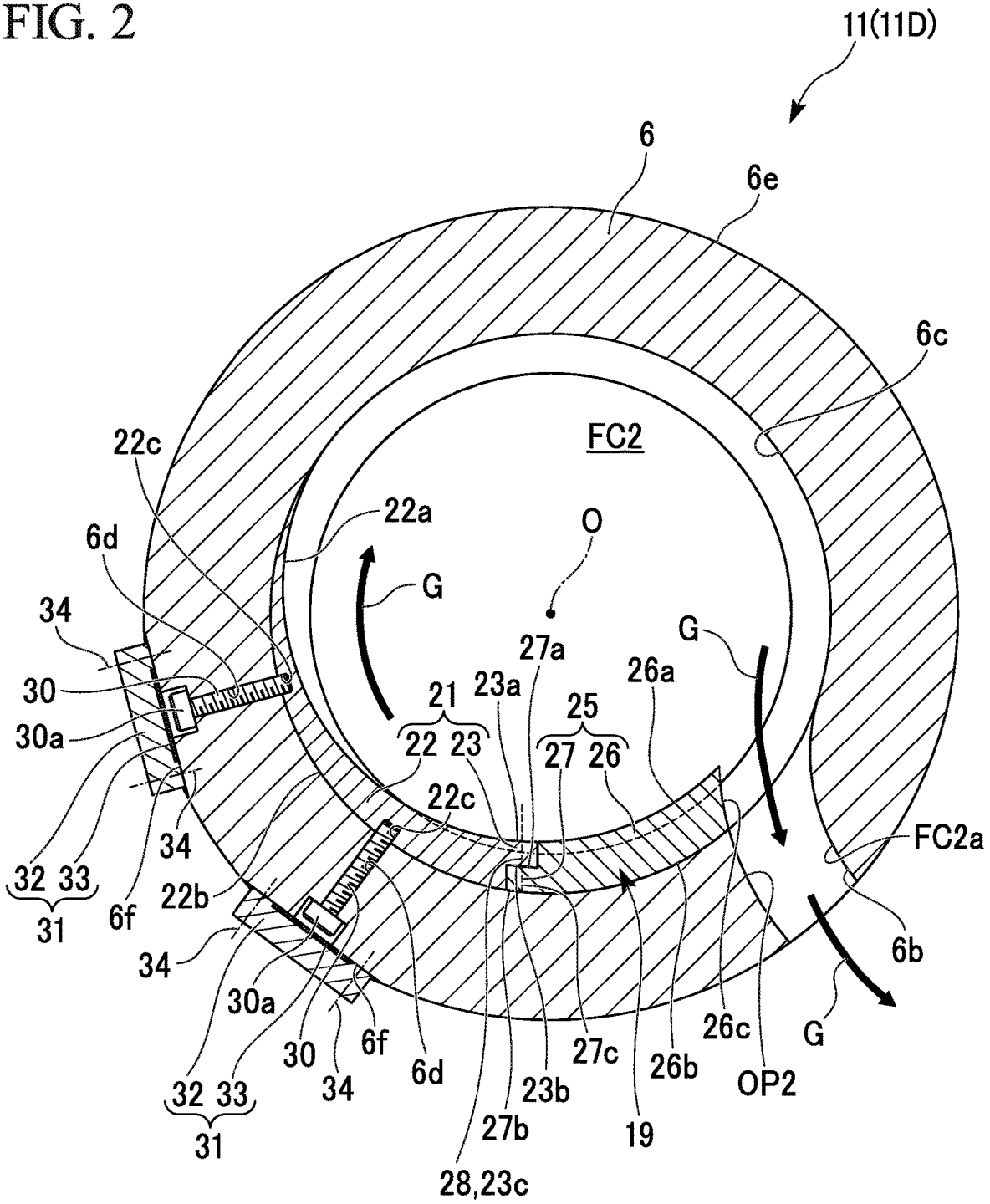
FIG. 2 is a cross-sectional view taken along line A-A of FIG. 1 illustrating a discharge flow channel and a volute piece of the centrifugal compressor according to the first embodiment of the present invention.

Specifically, as illustrated in FIG. 2, the volute piece 19 is a member which is provided over approximately a half circumference in the circumferential direction of the rotating shaft 2, and has a wall thickness dimension in the radial direction which gradually decreases toward the discharge flow channel opening OP2 which is on the downstream side in the flowing direction of the process gas G in the circumferential direction.

In the present embodiment, the volute piece 19 has a first piece portion 21 disposed on the downstream side in the flowing direction of the process gas G, and a second piece portion 25 which is a body separate from the first piece portion 21 and is disposed on the upstream side of the first piece portion 21 in the flowing direction of the process gas G.

That is, the second piece portion 25 is disposed on the side close to the discharge flow channel opening OP2, and the first piece portion 21 is disposed on the side spaced apart from the discharge flow channel opening OP2.

The first piece portion 21 includes a main body portion 22 curved in the circumferential direction along the inner surface 6*c* of the casing main body 6, and a protruding portion 23 protruding in the circumferential direction from the upstream side of the main body portion 22 toward the second piece portion 25.

In the main body portion 22, an inner surface 22*a* facing radially inward is a surface curved along the circumferential direction.

The main body portion 22 has a bolt hole 22*c* formed therein, which extends from the outer surface 22*b* facing radially outward, which is a surface facing the inner surface 6*c* of the casing main body 6, to the intermediate position in the radial direction toward the inner side in the radial direction. Female screws are formed in the bolt holes 22*c*. The bolt holes 22*c* are formed in two places to be spaced apart in the circumferential direction.

The end portion of the main body portion 22 on the downstream side has a thin wall thickness in the radial direction.

The protruding portion 23 protrudes from the end portion on the radially inner side of the surface facing the upstream side of the main body portion 22, and is formed integrally with the main body portion 22. The inner surface 23*a* facing the radially inner side of the protruding portion 23 is flush with the inner surface 22*a* of the main body portion 22, and is a surface curved along the circumferential direction.

The second piece portion 25 has a main body portion 26 curved in the circumferential direction along the inner surface 6*c* of the casing main body 6, and an engaging portion 27 protruding in the circumferential direction from the downstream side of the main body portion 26 toward the first piece portion 21.

In the main body portion 26, the inner surface 26*a* facing the inner side in the radial direction is a surface curved along the circumferential direction. The inner surface 26*a* is flush with the inner surface 22*a* of the main body portion 22 of the first piece portion 21 and the inner surface 23*a* of the protruding portion 23.

The end surface 26*c* facing the upstream side of the main body portion 26 is smoothly connected to the inner surface FC2*a* of the discharge flow channel opening OP2 in a non-stepped state.

The engaging portion 27 protrudes from the end portion on the radially outer side of the surface facing the downstream side of the main body portion 26, and is formed integrally with the main body portion 26. The outer surface 27*b* facing radially outward from the engaging portion 27 is continuously flush with the outer surface 26*b* facing radially outward from the main body portion 26 and the outer surface 22*b* of the main body portion 22 of the first piece portion 21.

The inner surface 27*a* facing the radially inner side of the engaging portion 27 comes into contact with the outer surface 23*b* facing the radially outer side of the protruding portion 23 of the first piece portion 21. Therefore, the protruding portion 23 of the first piece portion 21 is engaged with the engaging portion 27, and the engaging portion 27 is supported by the protruding portion 23 from the inner side in the radial direction.

When the bolt 28 is inserted through the through-hole 23*c* penetrating the protruding portion 23 in the radial direction, and is screwed into the bolt hole 27*c* formed in the engaging portion 27 to extend in the radial direction, the protruding portion 23 and the engaging portion 27 are connected to each other.

The fastening member 30 is, for example, a bolt or the like, and is provided in the casing main body 6 from the radially outer side to fix the volute piece 19 to the casing main body 6, thereby forming a discharge volute in the casing 5.

Here, a through-hole 6*d* penetrating the casing main body 6 in the radial direction is formed in the casing main body 6 at a position corresponding to each bolt hole 22*c* formed in the first piece portion 21.

The fastening member 30 is inserted through the through-hole 6*d* and screwed into the bolt hole 22*c* of the first piece portion 21.

A bolt head 30*a* of the bolt serving as the fastening member 30 enters the through-hole 6*d* formed in the casing main body 6 and does not protrude outward in the radial direction from the outer surface 6*e* of the casing main body 6.

The closing member 31 has a blind flange 32 formed to have a larger diameter than the bolt head 30*a*, and a metallic packing 33 sandwiched between the blind flange 32 and the through-hole 6*d*. The closing member 31 closes the through-hole 6*d* from the radially outer side.

The blind flange 32 is disposed in a recessed portion 6*f* recessed from the outer surface 6*e* of the casing main body 6 in a region including the opening of the through-hole 6*d*, and is fixed to the casing main body 6 by bolts 34. The thickness dimension of the blind flange 32 in the radial direction is larger than the depth dimension of the recessed portion 6*f* in the radial direction. Therefore, the blind flange 32 is provided in a state of protruding radially outward from the recessed portion 6*f*.

According to the aforementioned centrifugal compressor 1, the discharge volute can be formed in the casing 5, by fastening and fixing the volute piece 19 to the casing main body 6 by the fastening member 30 in the discharge flow channel FC2 of the bundle 10. Therefore, unlike a case where the volute piece 19 is welded and fixed to the casing main body 6, it is possible to avoid the occurrence of cracking of the welded portion of the casing main body 6 or the volute piece 19 at the time of fixing the volute piece 19.

In particular, in a case where the aforementioned high-strength material is used for the casing main body 6, very high welding technique is required when fixing the volute piece 19 to the casing main body 6 by welding. However, in the present embodiment, the volute piece 19 can be fixed to the casing main body 6 without using welding. Therefore, regardless of the material of the casing main body 6, it is possible to easily form the discharge volute in the casing 5.

Further, since the fastening member 30 is provided from the outside of the casing main body 6 to fix the volute piece 19 to the casing main body 6, the fixing work of the volute piece 19 is easy and the number of working steps can be reduced.

Furthermore, by providing the blind flange 32 as the closing member 31, even if the fastening member 30 is provided from the outside of the casing main body 6 as in the present embodiment, it is possible to prevent the process gas G in the discharge flow channel FC2 from leaking outside of the casing main body 6 through the through-hole 6*d*.

Further, since the volute piece 19 is divided into the first piece portion 21 and the second piece portion 25, the volute piece 19 is easily fixed to the casing main body 6.

Furthermore, during operation of the centrifugal compressor 1, when pressure acts on the casing main body 6, for example, the casing main body 6 may be deformed such that its diameter expands. In this case, when the deformation amount of the casing main body 6 and the deformation amount of the volute piece 19 are different from each other, there is a possibility that the deformation of the volute piece 19 may not be able to follow the deformation of the casing main body 6.

Here, unlike the case where the volute piece 19 is integrally formed, since the volute piece 19 is divided into the first piece portion 21 and the second piece portion 25, if a gap is formed in the divided portion, it is possible to absorb the deformation of the casing main body 6 at the divided portion. Therefore, it is possible to suppress cracking or the like of the volute piece 19 at the time of deformation of the casing main body 6.

That is, it is possible that the volute piece 19 is fixed to the casing main body 6 in a state in which a gap is provided between the first piece portion 21 and the second piece portion 25.

Further, in some cases, it is difficult to fasten and fix one of the first piece portion 21 and the second piece portion 25 to the casing main body 6, for example, due to the absence of working space and the interference of the components of the casing main body 6. Even in such a case, by supporting the engaging portion 27 of the second piece portion 25 from the inside in the radial direction by the protruding portion 23 of the first piece portion 21, when only the first piece portion 21 is fastened and fixed to the casing main body 6, the second piece portion 25 can also be fixed to the casing main body 6.

Figure 5:
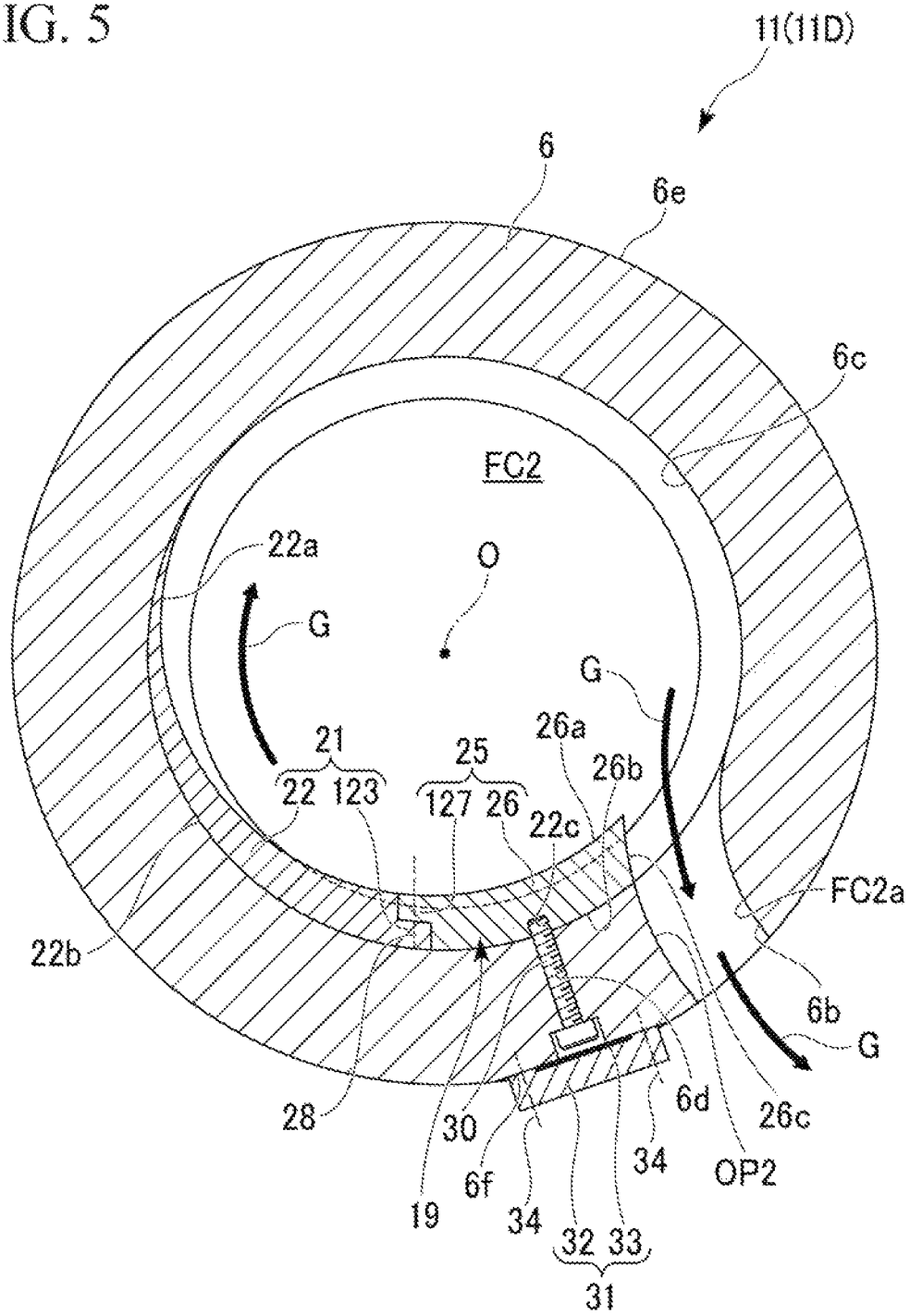
FIG. 5 is a cross-sectional view taken along line A-A of FIG. 1 illustrating a discharge flow channel and a volute piece of the centrifugal compressor according to the first embodiment of the present invention.

That is, when the first piece portion 21 is fixed to the casing main body 6 with the fastening member 30, the protruding portion 23 supports the engaging portion 27 so that the engaging portion 27 is pressed against the casing main body 6, and the second piece portion 25 can be fixed to the casing main body 6. FIG. 5 shows an opposite configuration where the second piece portion 21 is fixed to the casing main body 6 instead of the first piece portion 21. As shown in FIG. 5, the first piece portion 21 includes the engaging portion 123 while the second piece portion 25 includes the protruding portion 127 to support the engaging portion 123 of the first piece portion 21.

In particular, since the first piece portion 21 is disposed at a position spaced apart from the discharge flow channel opening OP2 of the discharge flow channel FC2, when the fastening member 30 is provided in the first piece portion 21, it is possible to prevent the interference of the fastening member 30 with the discharge port 6*b* or the like connected to the discharge flow channel FC2, and it is possible to easily fix the volute piece 19 to the casing main body 6.

In the present embodiment, the shapes of the protruding portion 23 and the engaging portion 27 may be configured so that the protruding portion 23 and the engaging portion 27 can be engaged with each other and the engaging portion 27 can be supported from the inner side in the radial direction by the protruding portion 23. For example, the protruding portion 23 may have a convex shape when viewed from the direction of the axis O and the engaging portion 27 may have a concave shape when viewed from the direction of the axis O, such that the protruding portion 23 and the engaging portion 27 may be fitted together.

Figure 3:
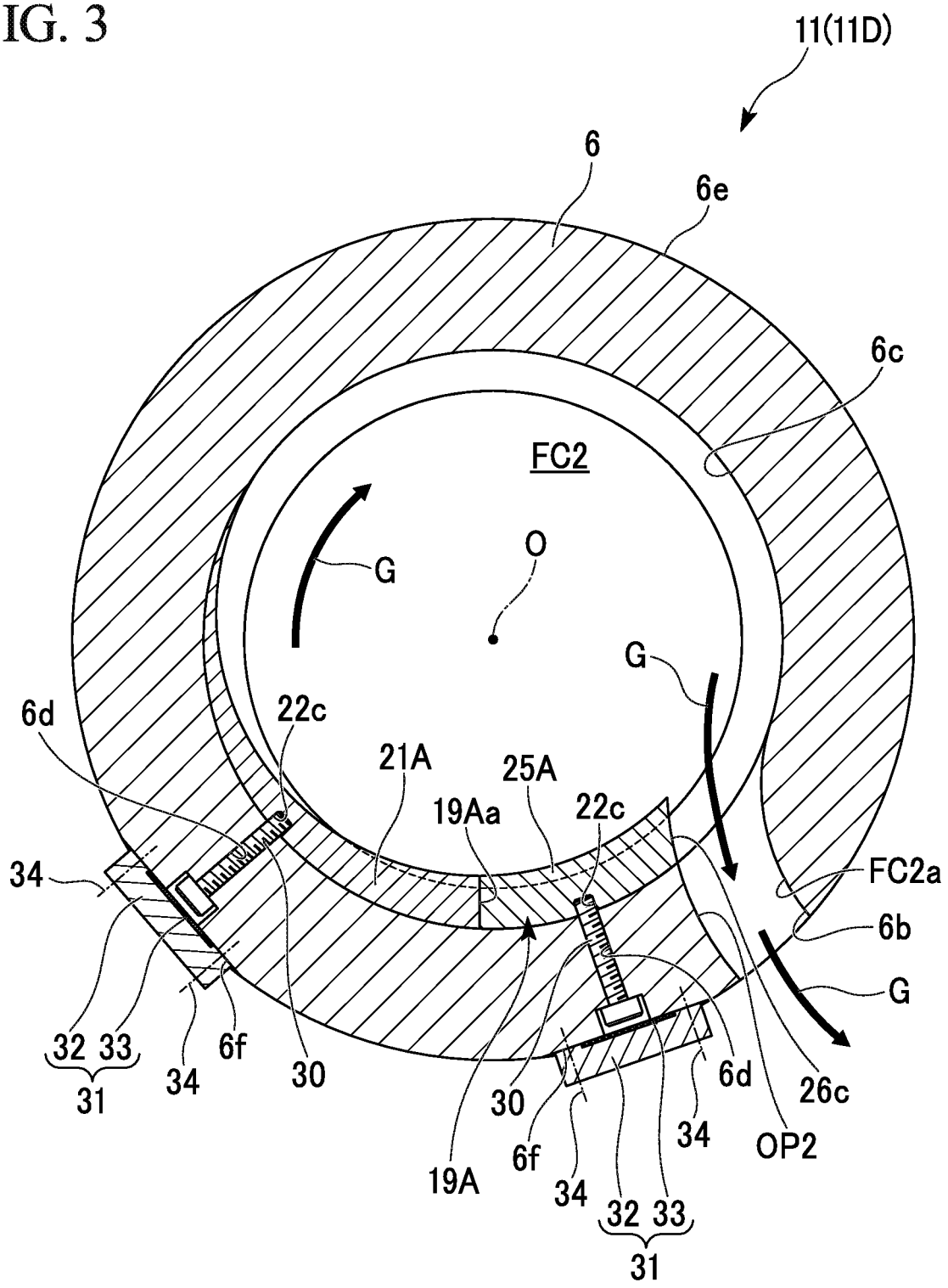
FIG. 3 is a cross-sectional view equivalent to the view taken along line A-A of FIG. 1 illustrating a discharge flow channel and a volute piece of a centrifugal compressor according to a modified example of the first embodiment of the present invention.

Here, as illustrated in FIG. 3, in the volute piece 19A, the first piece portion 21A may not have a portion corresponding to the protruding portion 23, and the second piece portion 25A may not have a portion corresponding to the engaging portion 27.

That is, the volute piece 19A is divided into a first piece portion 21A and a second piece portion 25A by a dividing surface 19Aa extending in the radial direction.

Further, each of the first piece portion 21A and the second piece portion 25A is fixed to the casing main body 6 by a fastening member 30.

Here, the volute pieces 19 and 19A may not necessarily be divided into two parts, or may be divided into a plurality of parts.

Second Embodiment

Figure 4:
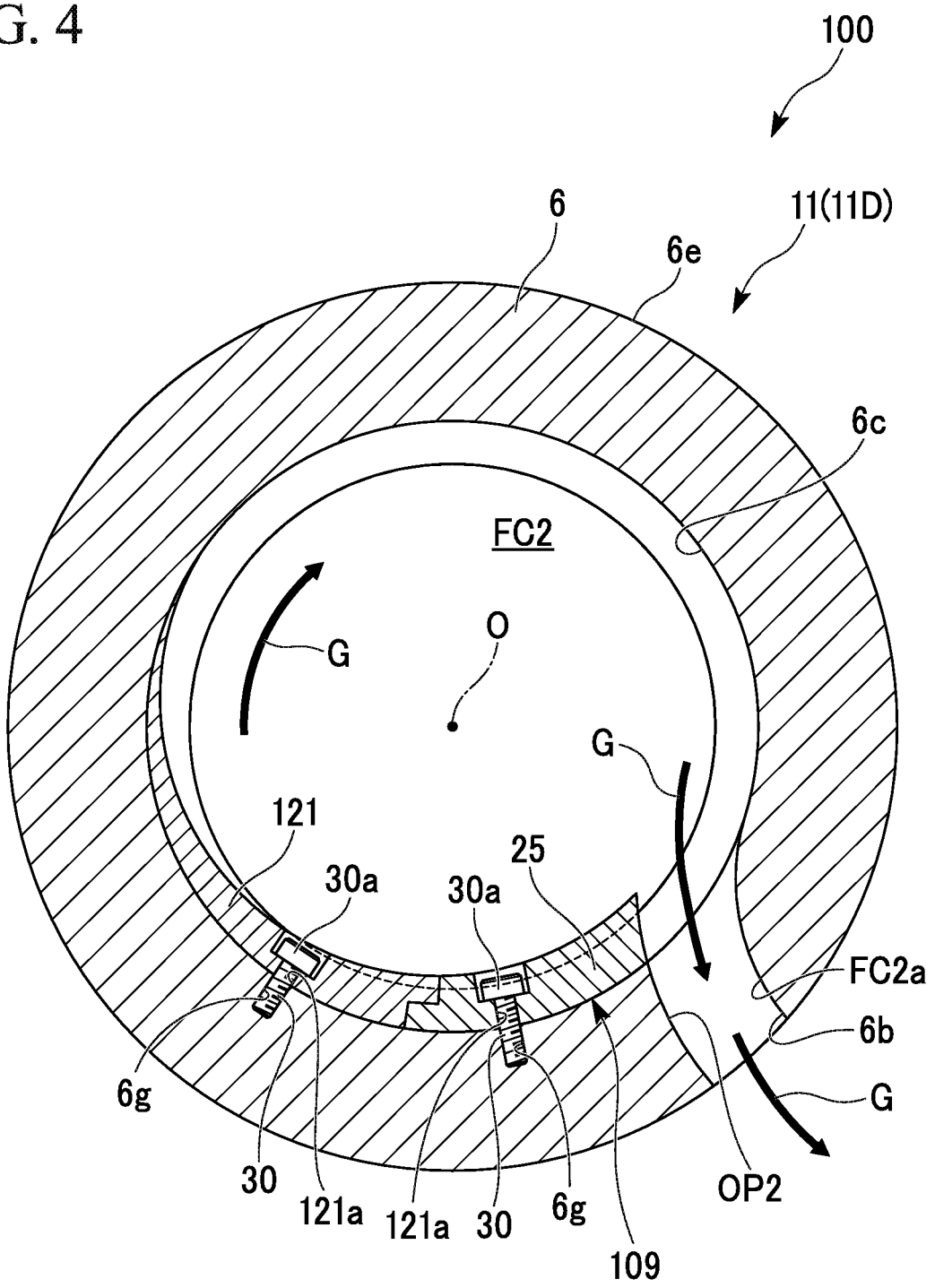
FIG. 4 is a cross-sectional view equivalent to the view taken along line A-A of FIG. 1 illustrating a discharge flow channel and a volute piece of a centrifugal compressor according to a second embodiment of the present invention.

Next, a second embodiment of the present invention will be described with reference to FIG. 4.

Constituent elements similar to those in the first embodiment are denoted by the same reference numerals, and a detailed description thereof will not be provided.

In the centrifugal compressor 100 of the present embodiment, a method for fixing the volute piece 109 to the casing main body 6 is different from that of the first embodiment.

That is, a through-hole 121*a* penetrating in the radial direction is formed in the first piece portion 121 of the volute piece 109. The through-holes 121*a* are formed in two places to be spaced apart from each other in the circumferential direction.

The casing main body 6 has a bolt hole 6*g* formed therein, extending from the inner surface 6*c* to the intermediate position in the radial direction toward the radially inner side. A female thread is formed in the bolt hole 6*g*. The position of the bolt hole 6*g* corresponds to the positions of the through-hole 121*a* of the first piece portion 121.

The fastening member 30 is inserted through the through-hole 121*a* of the first piece portion 121 to penetrate the volute piece 109 from the inner side in the radial direction, and is screwed and fixed to the bolt hole 6*g* of the casing main body 6 to fix the volute piece 109 to the casing main body 6.

According to the aforementioned centrifugal compressor 100 of the present embodiment, by providing the fastening member 30 from the inner side of the casing main body 6, it is possible to prevent the fastening member 30 from penetrating the casing main body 6. Therefore, the discharge flow channel FC2 does not open to the outside of the casing main body 6, and there is no need to separately provide a member which closes the opening of the through-hole 6*d* of the casing main body 6 as in the closing member 31 of the first embodiment (see FIG. 2).

Although the embodiments of the present invention have been described in detail with reference to the drawings, the respective configurations in each embodiment, combinations thereof, and the like are merely examples, and additions, omissions, substitutions, and other changes of configurations may be made without departing from the spirit of the present invention. Also, the present invention is not limited by the embodiments, and is limited only by the scope of the claims.

INDUSTRIAL APPLICABILITY

In the centrifugal compressor casing and the centrifugal compressor, it is possible to easily form a discharge volute, regardless of the material.

REFERENCE SIGNS LIST

1, 100 Centrifugal compressor
2 Rotating shaft
3, 3A, 3B Impeller
4 Impeller group
4 A First impeller group
4B Second impeller group
5 Casing
6 Casing main body
6*a* Suction port
6*b* Discharge port
6*c* Inner surface
6*d* Through-hole
6*e* Outer surface
6*f* Recessed portion
6*g* Bolt hole
10 Bundle

11 Diaphragm
11A Suction diaphragm
11B First intermediate diaphragm
11C Second intermediate diaphragm
11D Discharge diaphragm
11E Final stage diaphragm
12 Head
15 Sealing device
19, 19A, 109 Volute piece
19Aa Dividing surface
21, 21A, 121 First piece portion
22 Main body portion
22*a* Inner surface
22*b* Outer surface
22*c* Bolt hole
23 Protruding portion
23*a* Inner surface
23*b* Outer surface
23*c* Through-hole
25, 25A Second piece portion
26 Main body portion
26*a* Timer surface
26*b* Outer surface
26*c* End surface
27 Engaging portion
27*a* Inner surface
27*b* Outer surface
27*c* Bolt hole
28 Bolt
30 Fastening member
30*a* Bolt head
31 Closing member
32 Blind flange
33 Packing
34 Bolt
121*a* Through-hole
FC Flow channel
FC1 Suction flow channel
OP1 Suction flow channel opening
FC2 Discharge flow channel
OP2 Discharge flow channel opening (outlet)
FC3 Return flow channel
FC4 Return flow channel
O Axis
G Process gas (fluid)

The invention claimed is:

1. A centrifugal compressor casing, comprising:

a bundle that rotatably supports a rotating shaft, and an impeller fixed to the rotating shaft and that rotates with the rotating shaft about an axis of the rotating shaft;

an annular suction flow channel centered on the axis that introduces fluid into a flow channel of the impeller;

an annular discharge flow channel centered on the axis that discharges the fluid from the flow channel of the impeller;

a casing main body that covers the bundle from an outer circumferential side;

a volute piece that is disposed on and in direct contact with an inner surface of the casing main body in the discharge flow channel, and has a thickness dimension in a radial direction of the rotating shaft which gradually decreases toward an outlet of the discharge flow channel in a downstream side in a flowing direction of the fluid, in the circumferential direction of the rotating shaft; and a fastening member that fixes the volute piece to the casing main body, wherein the volute piece comprises a first piece portion disposed on the downstream side in the flowing direction of the fluid; and a second piece portion that is formed separately from the first piece portion and is disposed on an upstream side of the first piece portion in the flowing direction of the fluid.

2. The centrifugal compressor casing according to claim 1, wherein the fastening member penetrates the casing main body from outside in the radial direction and is fixed to the volute piece to fix the volute piece to the casing main body, and the centrifugal compressor casing further comprises a closing member which is provided on the casing main body from the outside in the radial direction, and closes a through-hole through which the fastening member penetrates the casing main body.

3. The centrifugal compressor casing according to claim 1, wherein the fastening member penetrates the volute piece from an inside in the radial direction and is fixed to the casing main body to fix the volute piece to the casing main body.

4. The centrifugal compressor casing according to claim 1, wherein the first piece portion comprises a protruding portion that protrudes toward the second piece portion in the circumferential direction, the second piece portion comprises an engaging portion that engages with the protruding portion and is supported from an inside in the radial direction by the protruding portion, and the fastening member is provided in first piece portion but not the second piece portion.

5. The centrifugal compressor casing according to claim 1, wherein a material of the casing main body is a high-strength material having a yield strength of 500 [N/mm$^2$] or more.

6. A centrifugal compressor, comprising:

the casing according to claim 1;

the rotating shaft supported by the casing to be rotatable with respect to the casing; and the impeller which is fixed to the rotating shaft and rotates inside the bundle with the rotating shaft.

7. The centrifugal compressor casing according to claim 1, wherein the second piece portion comprises a protruding portion that protrudes toward the first piece portion in the circumferential direction, the first piece portion comprises an engaging portion that engages with the protruding portion and is supported from an inside in the radial direction by the protruding portion, and the fastening member is provided in the second piece portion but not the first piece portion.

* * * * *